US011365081B2

(12) United States Patent
Ikeda et al.

(10) Patent No.: US 11,365,081 B2
(45) Date of Patent: Jun. 21, 2022

(54) PAPER SHEET ACCUMULATING DEVICE AND CONTROL METHOD OF PAPER SHEET ACCUMULATING DEVICE

(71) Applicant: FUJITSU FRONTECH LIMITED, Inagi (JP)

(72) Inventors: Masato Ikeda, Inagi (JP); Nobuhiko Ishii, Inagi (JP); Hayato Minamishin, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 150 days.

(21) Appl. No.: 16/989,060

(22) Filed: Aug. 10, 2020

(65) Prior Publication Data

US 2020/0369488 A1 Nov. 26, 2020

Related U.S. Application Data

(63) Continuation of application No. PCT/JP2018/006318, filed on Feb. 21, 2018.

(51) Int. Cl.

| | |
|---|---|
| ***B65H 29/40*** | (2006.01) |
| ***G07D 11/165*** | (2019.01) |
| ***G07D 11/20*** | (2019.01) |
| ***B65H 31/10*** | (2006.01) |
| ***G07D 11/16*** | (2019.01) |

(52) U.S. Cl.

CPC ..... *B65H 29/40* (2013.01); *B65H 31/10* (2013.01); *G07D 11/16* (2019.01); *G07D 11/165* (2019.01); *G07D 11/20* (2019.01); *B65H 2301/42262* (2013.01); *B65H 2404/1114* (2013.01);

(Continued)

(58) Field of Classification Search

CPC ..... B65H 29/40; B65H 31/10; B65H 2404/1114; B65H 2404/1521

See application file for complete search history.

(56) References Cited

U.S. PATENT DOCUMENTS 4,718,655 A * 1/1988 Okayama ..... G07D 11/10 271/215

9,517,911 B2 12/2016 Xia

FOREIGN PATENT DOCUMENTS

| | | |
|---|---|---|
| JP | 52-66206 | 5/1977 |
| JP | 61-114934 | 6/1986 |

(Continued)

OTHER PUBLICATIONS

Japanese Office Action, dated Jun. 28, 2021, in corresponding Japanese Patent Application No. 2020-501911 (5 pp.).

(Continued)

*Primary Examiner* — Jeremy R Severson

(74) *Attorney, Agent, or Firm* — Staas & Halsey LLP

(57) ABSTRACT

A paper sheet accumulating device includes an accumulating part in which paper sheets are accumulated, an impeller that sends the paper sheets to the accumulating part, and a support mechanism that supports the impeller. The support mechanism includes a first rotation shaft that supports the impeller rotatable, a support member provided with the first rotation shaft, a second rotation shaft that supports the support member rotatable in a direction of the support member moving toward and away from the accumulating part, and a biasing member that biases the support member in a direction of the impeller moving toward the paper sheets accumulated in the accumulating part.

6 Claims, 7 Drawing Sheets

(52) U.S. Cl.
CPC ..... *B65H 2404/1521* (2013.01); *B65H 2701/1912* (2013.01); *G07D 2211/00* (2013.01)

(56) References Cited

FOREIGN PATENT DOCUMENTS

| | | |
|---|---|---|
| JP | 62-218356 | 9/1987 |
| JP | 1-143757 | 10/1989 |
| JP | 2-57872 | 4/1990 |
| JP | 9-48552 | 2/1997 |
| JP | 2005-247497 | 9/2005 |
| JP | 2007-55751 | 3/2007 |
| JP | 2009-20546 | 1/2009 |
| JP | 2015-56126 | 3/2015 |

OTHER PUBLICATIONS

Chinese Office Action, dated Jul. 26, 2021, in corresponding Chinese Patent Application No. 201880089277.2 (20 pp.).
Notice of Reasons for Refusal, dated Feb. 9, 2021, in corresponding Japanese Application No. 2020-501911 (6 pp.).
International Search Report dated May 22, 2018 in corresponding International Patent Application No. PCT/JP2018/006318.
Japanese Office Action, dated Jul. 6, 2021, in corresponding Japanese Patent Application No. 2020-501911 (5 pp.).

* cited by examiner

PAPER SHEET ACCUMULATING DEVICE AND CONTROL METHOD OF PAPER SHEET ACCUMULATING DEVICE

CROSS-REFERENCE TO RELATED APPLICATION

This application is a continuation application of International Application PCT/JP2018/006318, filed on Feb. 21, 2018 and designating the U.S., the entire contents of which are incorporated herein by reference.

FIELD

The present invention relates to a paper sheet accumulating device and a control method of the paper sheet accumulating device.

BACKGROUND

For example, a banknote handling apparatus used as an automated teller machine (ATM) or the like, includes a banknote accumulating device in which banknotes, which are collected by the banknote handling apparatus, are stored. Such a banknote accumulating device includes an accumulating part in which banknotes are accumulated, and an impeller that sends banknotes to the accumulating part.

Patent Literature 1: Japanese Laid-open Patent Publication No. 1997-48552

In the above-described banknote accumulating device, for example, accumulating banknotes, which have folds or wrinkles, causes the banknotes to be bulky in the accumulating part, which becomes a problem of a decrease in storage capacity of the accumulating part in accordance with a deformation state of the banknotes accumulated.

For this reason, in the banknote accumulating device of the related art, causing a pressing member to press the banknotes, which are accumulated in the accumulating part, suppresses a decrease in storage amount of the banknotes accumulated in the accumulating part. However, in this banknote accumulating device, the provision of the pressing member and a drive mechanism that drives the pressing member, has a disadvantage that the banknote accumulating device is increased in size and complicated in structure.

SUMMARY

According to an aspect of the embodiments, a paper sheet accumulating device includes: an accumulating part in which paper sheets are accumulated;

an impeller that sends the paper sheets to the accumulating part; and a support mechanism that supports the impeller, wherein the support mechanism includes a first rotation shaft that supports the impeller rotatable, a support member provided with the first rotation shaft, a second rotation shaft that supports the support member rotatable in a direction of the support member moving toward and away from the accumulating part, and a biasing member that biases the support member in a direction of the impeller moving toward the paper sheets accumulated in the accumulating part.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

A description will be given below of details of an embodiment of a paper sheet accumulating device and a control method of the paper sheet accumulating device disclosed herein with reference to the drawings. Note that the paper sheet accumulating device and the control method of the paper sheet accumulating device disclosed herein, are not limited by the following embodiment.

Embodiment

[Structure of Banknote Handling Apparatus]

Figure 1:
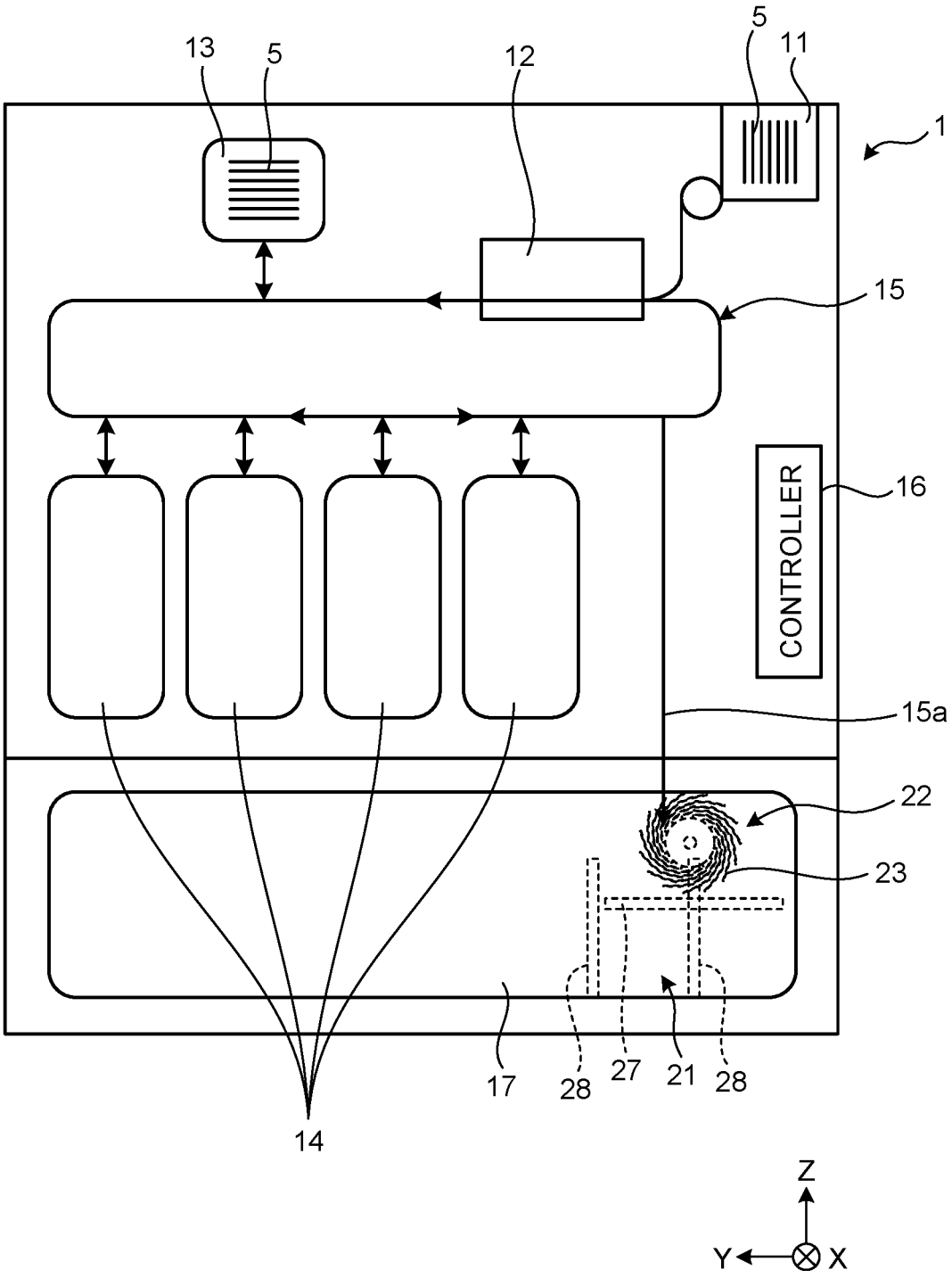
FIG. 1 is a schematic diagram illustrating the whole of a banknote handling apparatus according to an embodiment.

FIG. 1 is a schematic diagram illustrating the whole of a banknote handling apparatus according to the embodiment. As illustrated in FIG. 1, banknote handling apparatus 1 according to the embodiment includes an accepting and dispensing part 11 that accepts and dispenses banknotes 5, and an identifying part 12 that identify the banknotes 5 received by the accepting and dispensing part 11. Further, the banknote handling apparatus 1 includes a holder 13 in which the banknotes 5, which are conveyed from the identifying part 12, are temporarily stored, a plurality of storing parts 14 in which the banknotes 5, which are sent from the holder 13, are stored, a conveyor 15 that conveys the banknotes 5, and a controller 16 that controls each of the components 11 to 15. The conveyor 15 has a plurality of conveyance rollers (not illustrated) arranged along a conveyance path 15*a* for the banknotes 5, and a drive mechanism (not illustrated) that drives the plurality of conveyance rollers.

Further, in order to collect the banknotes 5 from the banknote handling apparatus 1, the banknote handling apparatus 1 includes a collecting part 17 that collects the banknotes 5 sent from the plurality of storing parts 14. As illustrated in FIG. 1, the collecting part 17 built in the banknote handling apparatus 1, corresponds to a banknote accumulating device according to the embodiment, and corresponds to a collection box in which the banknotes 5, which are collected from the banknote handling apparatus 1, are stored. Hereinafter, the collecting part 17 of the banknote handling apparatus 1 will be referred to as a banknote accumulating device 17.

For convenience of explanation, when the banknote handling apparatus 1 is viewed from the accepting and dispensing part 11 in FIG. 1, a width direction of the banknote handling apparatus 1 is referred to as an X direction, a front-rear direction of the banknote handling apparatus 1 is referred to as a Y direction, and a vertical direction of the banknote handling apparatus 1 is referred to as a Z direction. The drawings after FIG. 1 also illustrate the X, Y, and Z directions as in FIG. 1. Further, according to the present embodiment, the banknotes 5 are used as an example of paper sheets, but the present invention is not limited to the banknotes 5. Examples of the paper sheet include bills, checks, gift certificates, various certificates, and a securities such as stock certificates.

[Structure of Banknote Accumulating Device]

Figure 2:
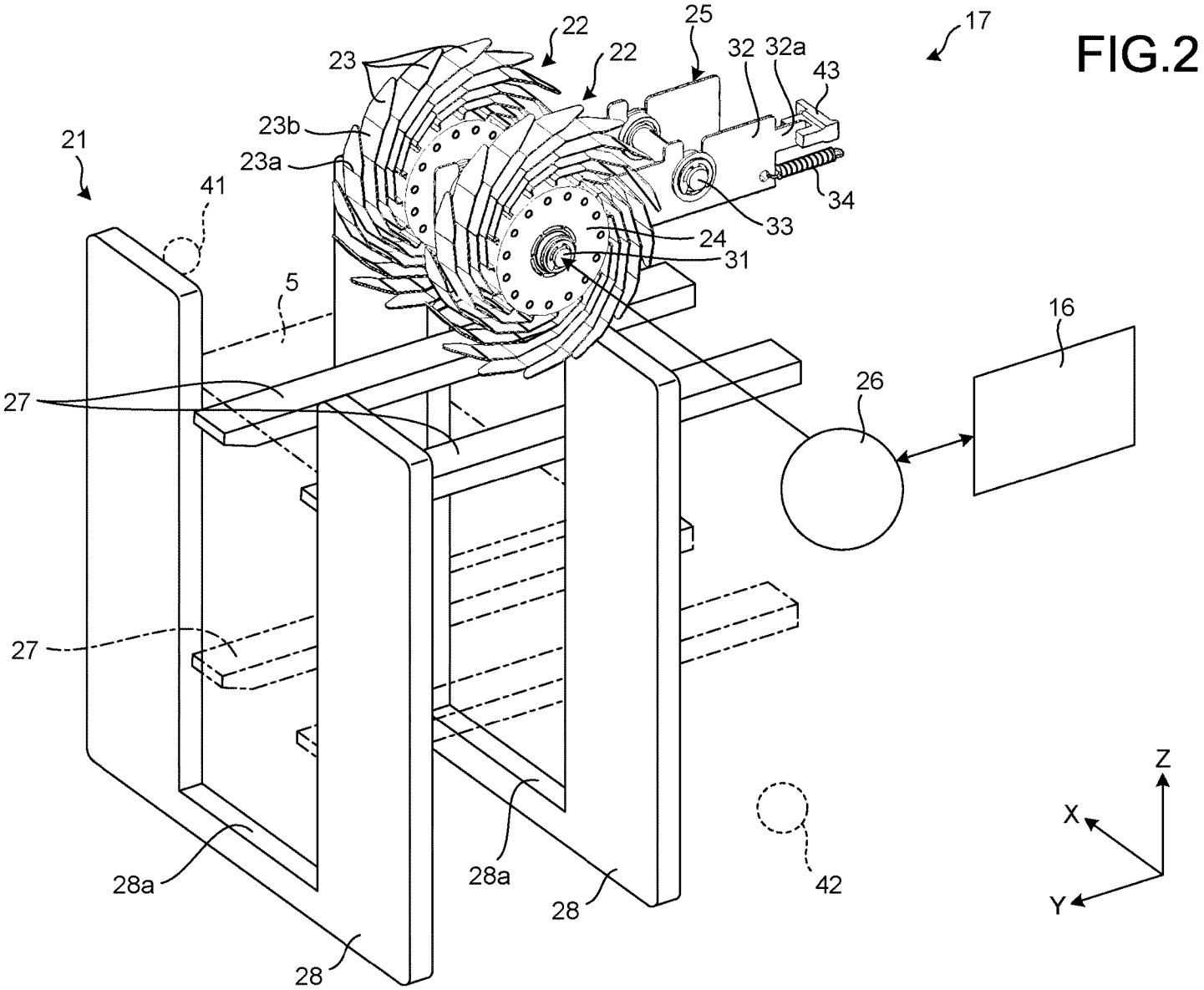
FIG. 2 is a perspective view illustrating a banknote accumulating device according to the embodiment.
Figure 3:
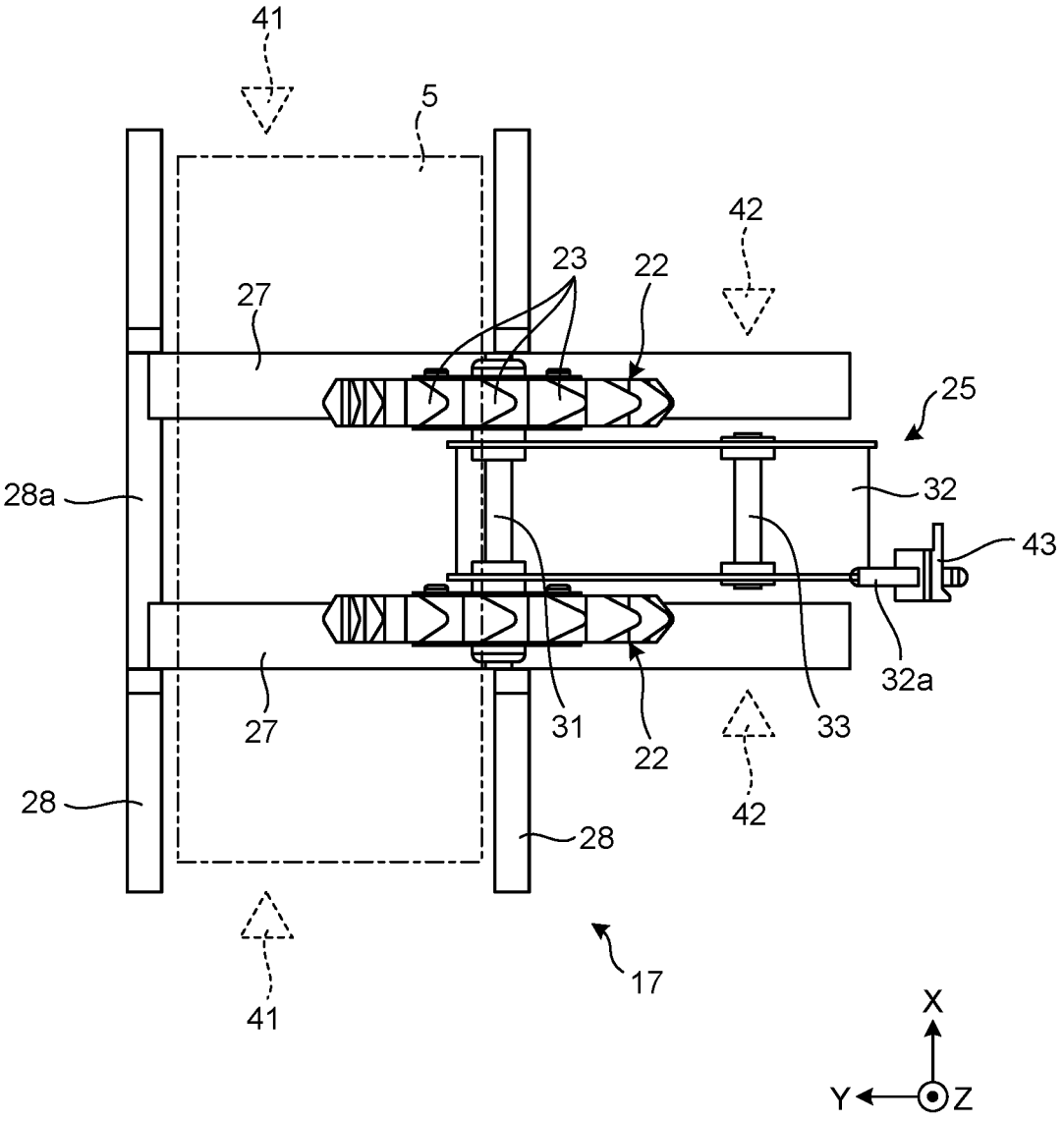
FIG. 3 is a plan view illustrating the banknote accumulating device according to the embodiment.

FIG. 2 is a perspective view illustrating the banknote accumulating device 17 according to the embodiment. FIG. 3 is a plan view illustrating the banknote accumulating device 17 according to the embodiment. As illustrated in FIG. 2 and FIG. 3, the banknote accumulating device 17 according to the embodiment includes an accumulating part 21 in which the banknotes 5 are accumulated, an impeller 22 that sends the banknotes 5 to the accumulating part 21, a support mechanism 25 that supports the impeller 22, and a drive mechanism 26 that performs rotation drive of the impeller 22. The drive mechanism 26 has a drive motor (not illustrated), and the drive motor is electrically connected to the above controller 16. The controller 16 controls the drive mechanism 26 to control the rotation drive of the impeller 22. Although the drive mechanism 26 according to the present embodiment is controlled by the controller 16, the banknote accumulating device 17 may include another controller separate from the controller 16 to control the drive mechanism 26.

The accumulating part 21 includes a pair of placing tables 27 on which the banknotes 5 are placed, a lift mechanism (not illustrated) that moves the pair of placing tables 27 up and down in the Z direction, and a pair of partitions 28 that partition a space where the banknotes 5 are accumulated.

The pair of the placing tables 27 are arranged horizontally (on an X-Y plane) at an interval along a longitudinal axis (X direction) of the banknotes 5 that are placed on the placing tables 27. The pair of the placing tables 27 have their respective one ends supported by the lift mechanism, and are intermittently moved down as the banknotes 5, which are sent from the impeller 22, are accumulated on the placing tables 27.

The pair of partitions 28 are arranged at an interval along a lateral axis (Y direction) of the banknotes 5 placed on the placing tables 27, the partitions 28 extending along the Z direction. The partitions 28 each have an opening 28*a*, in which the pair of the placing tables 27 are arranged and the pair of the placing tables 27 are moved up and down.

Further, on upper and lower sides of the accumulating part 21, an upper end detecting sensor 41 and a lower end detecting sensor 42 to be described later, are provided as illustrated in FIG. 2 and FIG. 3.

As illustrated in FIG. 3, two impellers 22 are arranged at an interval along the longitudinal axis of the banknotes 5 placed on the placing tables 27. The impellers 22 each have a plurality of metal blades 23, and a center portion 24 that has a cylindrical shape and supports the plurality of blades 23. The plurality of blades 23 have their proximal ends fixed to a circumference surface of the center portion 24 at intervals along the circumference of the center portion 24.

Figure 4:
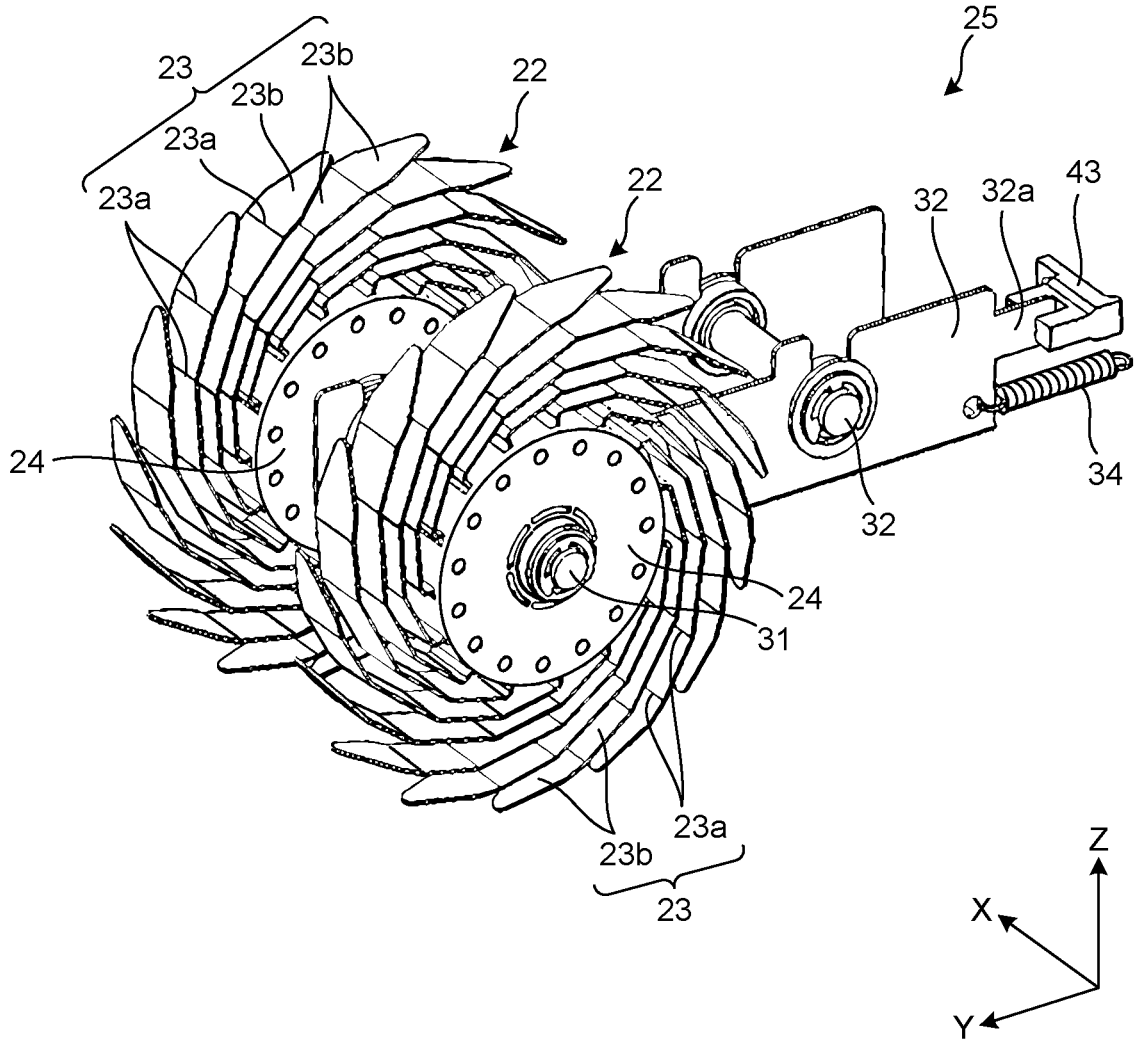
FIG. 4 is a perspective view illustrating an impeller and a support mechanism of the banknote accumulating device according to the embodiment.

The blades 23 are each formed of a metal plate into a band shape, and have a plurality of bent portions 23*a* bent at intervals along a longitudinal axis of the blades 23, and a plurality of flat portions 23*b* formed on both sides of each of the bent portions 23*a* (between the bent portions 23*a*) (see FIG. 4). Accordingly, the blades 23 are each bent in an approximately arc shape along the longitudinal axis. Such metal blades 23 have desired resilience to press the banknotes 5 accumulated in the accumulating part 21 along an accumulation direction (Z direction). Further, the metal blades 23 can cause the flat portions 23*b* (plane) between the bent portions 23*a* to press a surface of the banknotes 5 in the accumulating part 21, and can smoothly push the banknotes 5 along the accumulation direction while suppressing friction between the blades 23 and the banknotes 5. Further, the metal blades 23 have the plurality of bent portions 23*a*, and the plurality of flat portions 23*b*, so that the metal blades 23 can be kept stable in a desired bent shape that can apply a desired pressing force to the banknotes 5 in the accumulating part 21.

The blades 23 are each formed in a predetermined outer shape by, for example, punching a metal plate. After the punching work, a peripheral edge of each blade 23 is polished to be smoother, which prevents the blade 23 from damaging the banknotes 5 when coming into contact with the banknotes 5. Further, the blades 23 are each formed, by press work, in an approximately arc shape bent at the plurality of bent portions 23*a*. The blades 23 are each formed, for example, such that an interval between the plurality of bent portions 23*a* (a length of the flat portion 23*b*) gradually increases from the proximal end to a distal end. Such blades 23 having the plurality of bent portions 23*a*, allow the banknotes 5 to smoothly enter from the conveyance path 15*a* to between the blades 23 of the impellers 22, which in turn makes it possible to increase a success rate of transfer action of the banknotes 5 between the conveyance path 15*a* and the impellers 22.

Note that, although the impellers 22 according to the present embodiment have the metal blades 23, resin blades may be used. The metal blades 23 are preferably made of metal because an appropriate pressing force can be easily applied by resilience of a metal plate.

[Structure of Support Mechanism]

Figure 5:
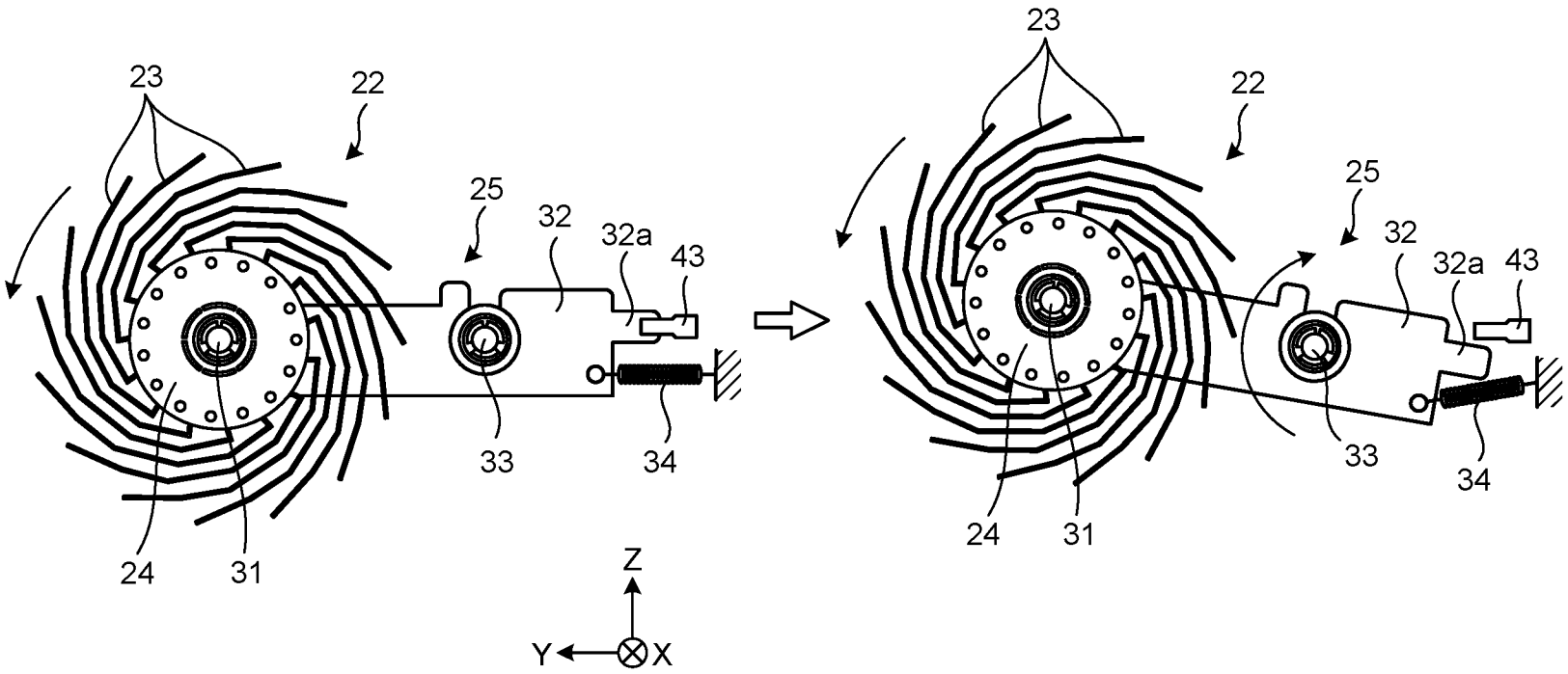
FIG. 5 is a side view illustrating action of the support mechanism of the banknote accumulating device according to the embodiment.

FIG. 4 is a perspective view illustrating the impellers 22 and the support mechanism 25 of the banknote accumulating device 17 according to the embodiment. FIG. 5 is a side view illustrating action of the support mechanism 25 of the banknote accumulating device 17 according to the embodiment. As illustrated in FIG. 4 and FIG. 5, the support mechanism 25 includes a first rotation shaft 31 that supports the impellers 22 rotatable, a support member 32 provided with the first rotation shaft, a second rotation shaft 33 that supports the support member 32 rotatable in a direction (Z direction) of the support member 32 moving toward and away from the accumulating part 21, and a biasing member 34 that biases the support member 32 in a direction of the impellers 22 moving toward to the banknotes 5, which are accumulated in the accumulating part 21.

Provided on the first rotation shaft 31 are the two impellers 22 that are arranged at an interval along an axis (X direction) of the first rotation shaft 31. The second rotation shaft 33 is disposed extending along the axis of the first rotation shaft 31, and is supported by a structure (not illustrated) of the banknote accumulating device 17. The support member 32 is provided with a detection piece 32*a*, which is used in detection of a pivot position by a position sensor 43 to be described later.

As the biasing member 34, a tension coil spring is used, for example, but a torsion coil that applies a rotation force about the second rotation shaft 33, may be used. The biasing member 34 has one end fixed to the support member 32 and the other end fixed to the structure of the banknote accumulating device 17. As described above, the support member 32 is biased around the second rotation shaft 33 by the biasing member 34 so as to allow the banknotes 5 to be accumulated while pressing the banknotes 5, which are accumulated in the accumulating part 21.

The banknote accumulating device 17 further includes the upper end detecting sensor 41 that detects an upper end position of the banknotes 5, which are accumulated in the accumulating part 21, the lower end detecting sensor 42 that detects a lower end position of the placing tables 27, and the position sensor 43 serving as a pivot detecting part, which detects that the support member 32 of the support mechanism 25 has pivoted on the second rotation shaft 33 to a predetermined pivot position. As the upper end detecting sensor 41, the lower end detecting sensor 42, and the position sensor 43, optical sensors are used, for example, the optical sensors each including a light emitter that emits detection light, and a light receiver that receives the detection light emitted by the light emitter. The upper end detecting sensor 41, the lower end detecting sensor 42, and the position sensor 43, are connected to the controller 16.

The upper end detecting sensor 41 is disposed on the upper side of the accumulating part 21, and detects the uppermost banknote 5 of the banknotes 5 accumulated on the placing tables 27. The lower end detecting sensor 42 is disposed on the lower side of the accumulating part 21, and detects the placing tables 27 when the placing tables 27 have intermittently moved down by the lift mechanism to the lower end.

As illustrated in FIG. 4 and FIG. 5, the position sensor 43 is disposed at a position corresponding to the detection piece 32*a* of the support member 32. The support member 32, which extends along a radial direction of the second rotation shaft 33, is made horizontal (parallel to the Y direction) at the initial position, and the detection piece 32*a* intercepts the detection light from the position sensor 43 when the support member 32 is at the initial position. As illustrated in FIG. 5, when the support member 32 has pivoted on the second rotation shaft 33 to the predetermined position to cause the detection piece 32*a* to separate from the position sensor 43, the light receiver of the position sensor 43 receives the detection light, and the position sensor 43 detects that the support member 32 has pivoted to the predetermined pivot position (pivoted by a predetermined pivot amount).

[Banknote Accumulating Action]

Figure 6:
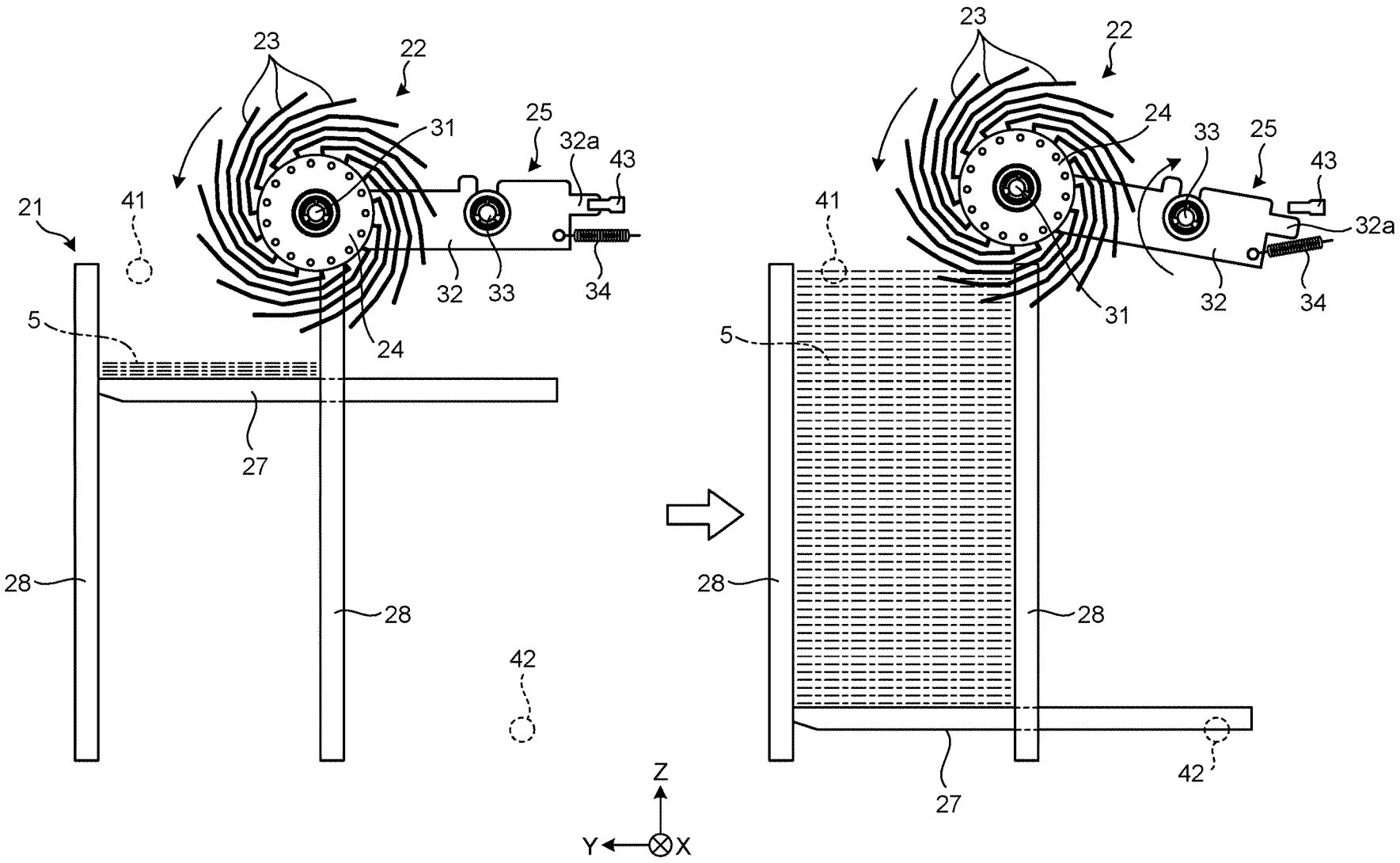
FIG. 6 is a cross-sectional view of the banknote accumulating device according to the embodiment, for describing banknote accumulating action of the banknote accumulating device.

FIG. 6 is a cross-sectional view of the banknote accumulating device 17 according to the embodiment, for describing accumulating action for the banknotes 5 of the banknote accumulating device 17. As illustrated in FIG. 6, the impellers 22 rotate counterclockwise in FIG. 6, so that the banknotes 5, which are conveyed through the conveyance path 15*a*, are sandwiched between the blades 23 and sent toward the placing tables 27, and are accumulated on the placing tables 27. The movement of the blades 23 of the rotating impellers 22 causes the banknotes 5 held between the blades 23 to be placed on the placing tables 27. After the banknotes 5 are placed on the placing tables 27, the movement of the banknotes 5 thus accumulated, is restricted to a space between the pair of partitions 28, so that the banknotes 5 are extracted from between the blades 23 and placed on the placing tables 27. At this time, of the blades 23, the flat portions 23*b* (plane) between the bent portions 23*a* smoothly move along the surface of the banknotes 5, and the blades 23 separate from the banknotes 5 thus accumulated.

The placing tables 27 are initially located on the upper side of the accumulating part 21, and are intermittently moved down by a predetermined height every time a predetermined amount of banknotes 5 are accumulated. This allows the banknote accumulating device 17 to further accumulate the banknotes 5 on the placing tables 27 by an amount corresponding to the height, by which the placing tables 27 have been moved down, and repeat the down movement of the placing tables 27 and the accumulating action.

When the placing tables 27 are moved down to the lower end of the accumulating part 21, the lower end detecting sensor 42 detects the placing tables 27. Then, even after the lower end detecting sensor 42 detects the placing tables 27, the impellers 22 keep being driven to rotate, and the banknotes 5 keep being accumulated.

As the banknotes 5 are further accumulated, the height of the banknotes 5 accumulated in the accumulating part 21, gradually increases. At this time, the impellers 22 are biased by the biasing member 34 toward the banknotes 5 in the accumulating part 21 via the support member 32, causing the blades 23 to press down the banknotes 5 in the accumulating part 21 in the accumulation direction. Thus, even when the banknotes 5, which have deformations such as folds or wrinkles, are accumulated, the banknotes 5 are pressed down by the blades 23 of the impellers 22, so that a storage capacity of the accumulating part 21 is appropriately maintained without a decrease in storage capacity.

Subsequently, the banknotes 5 in the accumulating part 21 are sufficiently pressed by the blades 23 of the impellers 22, and as the height of the banknotes 5, which are accumulated in the accumulating part 21, gradually increases, the impellers 22 gradually move upward. Therefore, the support member 32, which supports the impellers 22, is gradually pivoted on the second rotation shaft 33 from the horizontal position to the predetermined pivot position. At this time, the position sensor 43 detects that the support member 32 has pivoted to the predetermined pivot position, and the controller 16 stops the drive mechanism 26 on the basis of the detection result of the position sensor 43 to stop the rotation drive of the impellers 22 and terminate the accumulating action of the banknotes 5.

As described above, the impellers 22 can gradually separate from the accumulating part 21 in proportion to the storage amount of the banknotes 5, which are accumulated in the accumulating part 21, and it is therefore possible to cause the impellers 22 to press the banknotes 5 in the accumulating part 21 with a constant pressing force and to suppress the occurrence of the banknotes 5 jamming in the accumulating part 21, that is, the occurrence of a jam. Further, the use of both the biasing force of the biasing member 34 and the weight of the impellers 22 to cause the impellers 22 to press the banknotes 5, makes it possible to simplify the structure for pressing the banknotes. Further, since the controller 16 stops the rotation drive of the impellers 22 on the basis of the detection result of the position sensor 43, it is possible to avoid the impellers 22 applying an excessive pressing force to the banknotes 5 in the accumulating part 21 and to cause the impellers 22 to press the banknotes 5 in the accumulating part 21 with a constant pressing force. Further, according to the present embodiment, since the banknotes 5 are pressed by the two impellers 22 arranged at an interval along the longitudinal axis of the banknotes 5 accumulated to appropriately press the banknotes 5 over the longitudinal axis of the banknotes 5, it is possible to satisfactorily accumulate the banknotes 5 in the accumulating part 21.

Subsequently, the banknote accumulating device 17 causes a conveyance mechanism (not illustrated) to convey the banknotes 5, which are accumulated on the placing tables 27, to remove the banknotes 5 from the placing tables 27. After the banknotes 5 are removed from the placing tables 27, the banknote accumulating device 17 causes the support member 32 supporting the impellers 22 to return to the initial position, by the biasing force of the biasing member 34, to move the placing tables 27 to the upper side of the accumulating part 21, allowing the banknote accumulating device 17 to start the accumulating action again.

[Control Processing of Banknote Accumulating Device]

Figure 7:
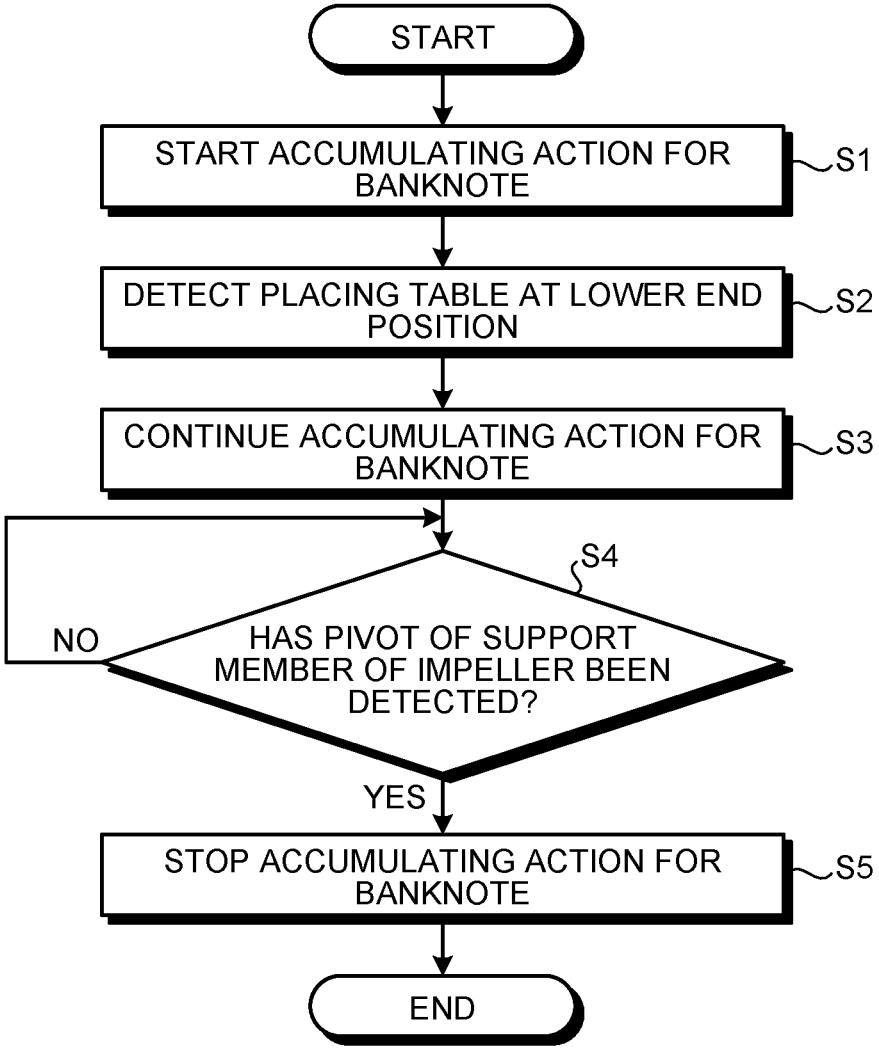
FIG. 7 is a flowchart for describing control processing of the banknote accumulating device according to the embodiment.

FIG. 7 is a flowchart for describing control processing of the banknote accumulating device 17 according to the embodiment. As illustrated in FIG. 7, the banknote accumulating device 17 starts the accumulating action for the banknotes 5 by performing the rotation drive of the impellers 22 (Step S1), and causes the lower end detecting sensor 42 to detect that the placing tables 27 has moved to the lower end position as the banknotes 5 are accumulated in the accumulating part 21 (Step S2). Even after the lower end detecting sensor 42 detects the placing tables 27, the controller 16 continues to perform the rotation drive of the impellers 22 to continue the accumulating action for the banknotes 5 (Step S3). As the storage amount of the banknotes 5 in the accumulating part 21, increases with the continuation of the accumulating action for the banknotes 5, the support member 32 for the impellers 22 gradually pivots on the second rotation shaft 33.

The controller 16 determines whether the position sensor 43 has detected that the support member 32 for the impellers 22 has pivoted to the predetermined pivot position (Step S4). In Step S4, when the controller 16 determines that it has not detected yet that the support member 32 has pivoted to the predetermined pivot position (No), the controller 16 returns to Step S4 and repeats the determination. In Step S4, when the controller 16 determines that the support member 32 has pivoted to the predetermined pivot position (Yes), the controller 16 stops the rotation drive of the impellers 22 to terminate the accumulating action for the banknotes 5 (Step S5).

For example, after the lower end detecting sensor 42 detects the placing tables 27, the controller 16 may perform control to detect whether a predetermined number of banknotes 5 have been sent to the accumulating part 21 by the impellers 22 and determine that, when the predetermined number or more of the banknotes 5 have been sent to the accumulating part 21, there is a risk of, for example, the banknotes 5 jamming in the accumulating part 21 to terminate the accumulating action even when the pivot of the support member 32 is not detected by the position sensor 43. This makes it possible to suppress the occurrence of, for example, the banknotes 5 jamming in the accumulating part 21 in a state where the position sensor 43 has not detected yet that the support member 32 has pivoted to the predetermined pivot position.

[Control Method of Banknote Accumulating Device]

A control method of the banknote accumulating device 17 configured as described above, includes causing the impellers 22 to send the banknotes 5 to the accumulating part 21, and accumulating the banknotes 5 on the placing tables 27 of the accumulating part 21 and causing the lower end detecting sensor 42 to detect that the placing tables 27 have reached the lower end with the accumulation of the banknotes 5. Further, this control method includes causing the position sensor 43 serving as the pivot detecting part to detect that the support member 32 has pivoted on the second rotation shaft 33 to the predetermined pivot position, using the support mechanism 25 having the first rotation shaft 31, the support member 32, the second rotation shaft 33, and the biasing member 34.

Control according to this control method is performed to continue the rotation drive of the impellers 22 even after the lower end detecting sensor 42 detects the placing tables 27, and stop, when the position sensor 43 detects that the support member 32 has pivoted to the predetermined pivot position, the rotation drive of the impellers 22.

As described above, the banknote accumulating device 17 according the embodiment includes the support mechanism 25 including the first rotation shaft 31 that supports the impellers 22 rotatable, the support member 32 provided with the first rotation shaft 31, the second rotation shaft 33 that supports the support member 32 rotatable in a direction of the support member 32 moving toward and away from the accumulating part 21, and the biasing member 34 that biases the support member 32 in a direction of the impellers 22 moving toward the banknotes 5 accumulated in the accumulating part 21. Accordingly, the impellers 22 can gradually separate from the accumulating part 21 in proportion to the storage amount of the banknotes 5 accumulated in the accumulating part 21, and it is therefore possible to cause the impellers 22 to press the banknotes 5 in the accumulating part 21 with a constant pressing force and to suppress the occurrence of, for example, the banknotes 5 jamming in the accumulating part 21 due to excessive pressing of the banknotes 5.

Therefore, according to the banknote accumulating device 17, even when the banknotes 5, which have deformations such as folds or wrinkles, are accumulated, causing the impellers 22 to press the banknotes 5 in the accumulating part 21 makes it possible to suppress a decrease in storage amount of the banknotes 5, which are accumulated in the accumulating part 21, in accordance with a deformation state of the banknotes 5. In addition, causing the impellers 22 to press the banknotes 5 makes it possible to simplify the structure for suppressing a decrease in storage amount of the banknotes 5, which are accumulated in the accumulating part 21, and to reduce the whole size of the banknote accumulating device 17.

Further, in the banknote accumulating device 17 according to the embodiment, the controller 16 performs control to continue to the rotation drive of the impellers 22 when the lower end detecting sensor 42 detects that the placing tables have reached the lower end with the accumulation of the banknotes 5 and to stop the rotation drive of the impellers 22 when the position sensor 43 detects that the support member 32 has pivoted to the predetermined pivot position. This prevents the impellers 22 from applying an excessive pressing force to the banknotes 5 in the accumulating part 21, and allows the impellers 22 to press the banknotes 5 in the accumulating part 21 with a constant pressing force.

Further, the impellers 22 included in the banknote accumulating device 17 according to the embodiment, have the plurality of blades 23 each formed of a metal plate, and the plurality of blades 23 have resilience to press the banknotes 5 accumulated in the accumulating part 21. Accordingly, a sufficient pressing force for pressing the banknotes 5 in the accumulating part 21 can be obtained, so that a decrease in the storage capacity of the accumulating part 21 can be further suppressed.

Further, the plurality of blades 23 of the impellers 22 in the banknote accumulating device 17 according to the embodiment, have the plurality of bent portions 23*a* bent at intervals along the longitudinal axis of the blades 23, and the plurality of flat portions 23*b* formed on both sides of each of the bent portions. This allows the metal blades 23 to press the surface of the banknotes 5 in the accumulating part 21 using the flat portions 23*b* (plane) between the bent portions 23*a*.

With the paper sheet accumulating device according to the aspect of the present disclosure, a structure for suppressing a decrease in storage amount of the paper sheets accumulated in the accumulating part can be simplified.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet accumulating device comprising:

an accumulating part in which paper sheets are accumulated;

an impeller that sends the paper sheets to the accumulating part; and a support mechanism that supports the impeller, wherein the support mechanism includes a first rotation shaft that supports the impeller rotatable, a support member provided with the first rotation shaft, a second rotation shaft that supports the support member rotatable in a direction of the support member moving toward and away from the accumulating part, and a biasing member that biases the support member in a direction of the impeller moving toward the paper sheets accumulated in the accumulating part.

2. The paper sheet accumulating device according to claim 1, further comprising:

a pivot detecting part that detects that the support member has pivoted on the second rotation shaft to a predetermined pivot position; and a controller that is configured to control rotation drive of the impeller, wherein when the pivot detecting part detects that the support member has pivoted to the predetermined pivot position, control is performed to stop the rotation drive of the impeller.

3. The paper sheet accumulating device according to claim 1, further comprising:

a lower end detecting part that detects that a placing table of the accumulating part has reached a lower end position; and a controller that is configured to control rotation drive of the impeller, wherein when the lower end detecting part detects that the placing table has reached the lower end position with accumulation of the paper sheets, the controller performs control to continue the rotation drive of the impeller.

4. The paper sheet accumulating device according to claim 1, wherein the impeller includes a plurality of blades each formed of a metal plate, and the plurality of blades have resilience to press the paper sheets accumulated in the accumulating part.

5. The paper sheet accumulating device according to claim 4, wherein the plurality of blades of the impeller include a plurality of bent portions bent at intervals along a longitudinal axis of the blades, and a plurality of flat portions formed on both sides of each of the bent portions.

6. A control method of a paper sheet accumulating device comprising:

causing an impeller to send paper sheets to an accumulating part;

accumulating the paper sheets on a placing table of the accumulating part, and causing a lower end detecting part to detect that the placing table has reached a lower end position with accumulation of the paper sheets; and causing a pivot detecting part to detect that a support member has pivoted on a second rotation shaft to a predetermined pivot position using a support mechanism including a first rotation shaft that supports the impeller rotatable, the support member provided with the first rotation shaft, the second rotation shaft that supports the support member rotatable in a direction of the support member moving toward and away from the accumulating part, and a biasing part that biases the support member in a direction of the impeller moving toward the paper sheets accumulated in the accumulating part, wherein even after the lower end detecting part detects that the placing table of the accumulating part has reached a lower end position with accumulation of the paper sheets, control is performed to continue rotation drive of the impeller, and when the pivot detecting part detects that the support member has pivoted to the predetermined pivot position, control is performed to stop the rotation drive of the impeller.

* * * * *